US007318877B2

(12) United States Patent
Harte

(10) Patent No.: US 7,318,877 B2
(45) Date of Patent: Jan. 15, 2008

(54) HIGH SPEED LABELING DEVICE AND METHOD

(75) Inventor: James R. Harte, Shawnee, KS (US)

(73) Assignee: Koch Equipment LLC, Kansas City, MO (US)

( * ) Notice: Subject to any disclaimer, the term of this patent is extended or adjusted under 35 U.S.C. 154(b) by 77 days.

(21) Appl. No.: 11/287,030

(22) Filed: Nov. 23, 2005

(65) Prior Publication Data

US 2007/0113965 A1 May 24, 2007

(51) Int. Cl.

| | |
|---|---|
| ***B65C 9/08*** | (2006.01) |
| ***B65C 9/42*** | (2006.01) |
| ***B44C 1/16*** | (2006.01) |
| *B65C 9/20* | (2006.01) |
| *B65C 3/06* | (2006.01) |

(52) U.S. Cl. ..... 156/249; 156/235; 156/238; 156/542; 156/DIG. 28; 156/DIG. 45

(58) Field of Classification Search ..... None
See application file for complete search history.

(56) References Cited

U.S. PATENT DOCUMENTS

| | | | | |
|---|---|---|---|---|
| 3,379,486 | A | 4/1968 | Hughes | |
| 3,871,943 | A | 3/1975 | Zodrow | |
| 4,046,613 | A * | 9/1977 | Kucheck et al. | 156/249 |
| 4,210,484 | A * | 7/1980 | Crankshaw et al. | 156/542 |
| 4,314,869 | A * | 2/1982 | Crankshaw | 156/215 |
| 4,324,608 | A * | 4/1982 | Klinger | 156/351 |
| 4,680,082 | A | 7/1987 | Kearney | |
| 5,281,296 | A | 1/1994 | Bellveau | |
| 5,401,231 | A | 3/1995 | Hebert | |
| 5,725,717 | A | 3/1998 | Harte et al. | |
| 6,006,808 | A | 12/1999 | Ewert et al. | |
| 6,149,755 | A | 11/2000 | McNichols et al. | |
| 6,558,490 | B2 | 5/2003 | Klein | |
| 6,634,404 | B2 | 10/2003 | Simon | |
| 6,868,887 | B2 | 3/2005 | Harte et al. | |
| 2004/0182505 | A1 * | 9/2004 | Greenhill et al. | 156/230 |

FOREIGN PATENT DOCUMENTS

EP 0073126 B1 * 8/1982

* cited by examiner

*Primary Examiner*—Melvin Mayes
*Assistant Examiner*—Sonya Mazumdar
(74) *Attorney, Agent, or Firm*—Hovey Williams LLP

(57) ABSTRACT

A high-speed labeling device (20) is provided for use on form, fill and seal packaging equipment or other types of thermoforming equipment. The device (20) includes a label dispensing unit (22) operable to sequentially and successively deliver a plurality of labels to a delivery location (56). A label transport assembly (24) is locates adjacent to unit (22) and has a shiftable label-receiving component (58) operable to receive labels (28). A control assembly (55, 68, 54*a*) is operably coupled with the dispensing unit (22) and transport assembly (24) in order to dispense the plural webs (28) as a group and without interruption in the movement of the component (58) during sequential dispensing of the labels (28). The device (20) can achieve labeling speeds up to 50% greater than those obtainable with conventional labelers.

10 Claims, 5 Drawing Sheets

HIGH SPEED LABELING DEVICE AND METHOD

BACKGROUND OF THE INVENTION

1. Field of the Invention

The present invention is broadly concerned with improved, high-speed labeling devices of the type used to label an array of packages in the context of form, fill and seal packaging machines or other types of package thermoforming devices. More particularly, the invention is concerned with such labelers and methods of operation thereof wherein a plurality of labels are dispensed as a group in a "burst" fashion, thereby eliminating time-consuming iterative stop-and-start of the labeler.

2. Description of the Prior Art

U.S. Pat. No. 6,543,505 describes highly successful labeling devices designed to apply labels on-line to packages in form, fill and seal thermoform packaging machines. The devices of the '505 patent are capable of using labels of a single roll and to apply the labels at a 90 degree angle to any package array. The device uses separate stepper motors for label web advancement and label peeling, for transporting, separating and applying the labels, and for selectively indexing the entire system to label multiple rows.

U.S. Pat. No. 6,868,887 describes further improvements in transverse labeling devices, with provision of an improved label tamper assembly which largely eliminates label fouling during operations.

The labelers described in the '505 and '887 patents are designed to dispense labels in a stepwise, distance-based, stop-and-start fashion. In particular, when a plurality of labels are to be dispensed, the label dispensing unit and label transport belt are operated intermittently in order to ensure accurate label location across the labeler. This type of operation is capable of very accurate label positioning; however, it is a relatively slow process, and indeed label dispensing in these units constitutes the rate-limiting step both of the labeler and sometimes of the entire packaging device.

U.S. Pat. No. 6,558,490 describes apparatus which dispenses labels continuously in a non-stop fashion. However, the labels are applied directly, one at a time onto packages in an in-line configuration. The speed of the dispenser is adjusted continuously between labels to match the random timing of products, so that products and labels meet simultaneously at an application point. U.S. Pat. No. 4,324,608 poses the concern of spacing labels prior to the advent of modern motion control systems. The patent describes use of mechanical stops to set the final positions of labels. U.S. Pat. No. 4,046,613 also describes older concept wherein labels are dispensed on a transporter and a moveable sensor is used to initiate operation of the label dispenser to set the position of the labels. In this design, the transporter and labeler head run at the same speed and label dispensing occurs intermittently, based upon reception of the sensor signal. Finally, U.S. Pat. No. 3,871,943 relates to a bottle labeler using a turret applicator.

There is accordingly a real and unsatisfied need in the art for an improved transverse labeling device designed to rapidly dispense a plurality of labels as a group in a "burst" manner, thereby eliminating the conventional stop-and-start operation of current labelers. It is possible that other workers in the art have attempted to provide such high-speed labeling devices.

SUMMARY OF THE INVENTION

The present invention overcomes the problems outlined above and provides high-speed labelers which are capable of dispensing labels at a rate up to 50% greater than current labelers. Broadly speaking, the labeling devices of the invention include a label dispensing unit operable to sequentially deliver a plurality of labels to a delivery location, together with a label transport assembly presenting a shiftable label-receiving component such as a belt operable to receive labels from the unit as they are sequentially delivered at the location and to support the plurality of labels in a final position. The labeling devices also include a label tamping assembly adjacent the transport assembly and operable to apply the labels in the final position thereof to packages or the like. A control assembly is operably coupled with the dispensing unit and the transport assembly in order to dispense a plurality of labels onto the label-receiving component as a group and without interruption in the movement of the label-receiving component during the sequential dispensing of the plurality of labels.

Preferably, the dispensing unit includes a label supply reel designed to hold a web roll supporting spaced labels, and a tensioning assembly for ensuring smooth, reliable label dispensing. A convention peelbar is located at the label dispensing location and serves to separate successive labels from the web during operation. The preferred transport assembly is in the form of a shiftable belt oriented to receive labels as they are successively stripped from the web.

The control assembly controls operation of both the label dispensing unit and the transport assembly in a manner such that the speed of the label-receiving belt is greater than that of the labels as they are stripped. As a consequence, until the labels are fully separated from the web, there is a relative slippage between the faster moving belt and the slower moving labels. Once the labels are fully free of the web, they instantaneously are moved with the belt.

In its method aspects, the invention involves dispensing a plurality of labels from a continues web supporting a number of the labels in space relationship. In the method, plurality of labels are successively removed from the web and are deposited onto a transport component such as a belt. At the same time, the label-receiving component is continuously moved during successive removal of the plural webs, so that the labels are deposited on the components without interrupting the continuous movement thereof.

DETAILED DESCRIPTION OF THE PREFERRED EMBODIMENT

The Preferred Labeler Apparatus

Figure 1:
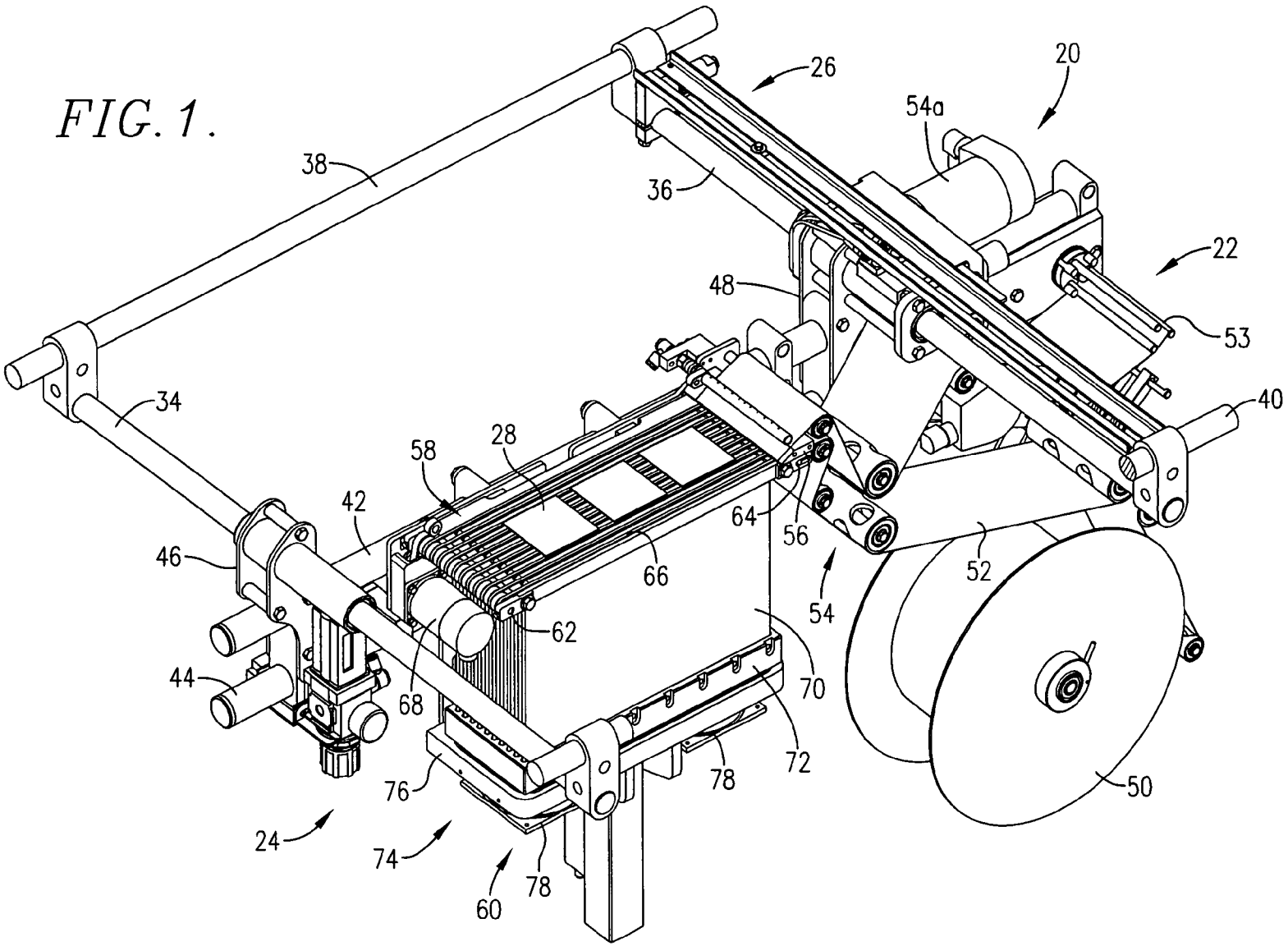
FIG. 1 is a fragmentary isometric view depicting a labeling device in accordance with the invention.

Turning now to the drawings, FIG. 1 depicts a labeling device 20 having a label dispensing unit 22 as well as a label transport assembly 24. The unit 22 and assembly 24 are supported by a frame assembly 26. The function of device 20 is to apply adhesive-coated labels 28 to packages 30 (see FIGS. 14 and 15) in synchronization with movement of the packages.

Figure 14:
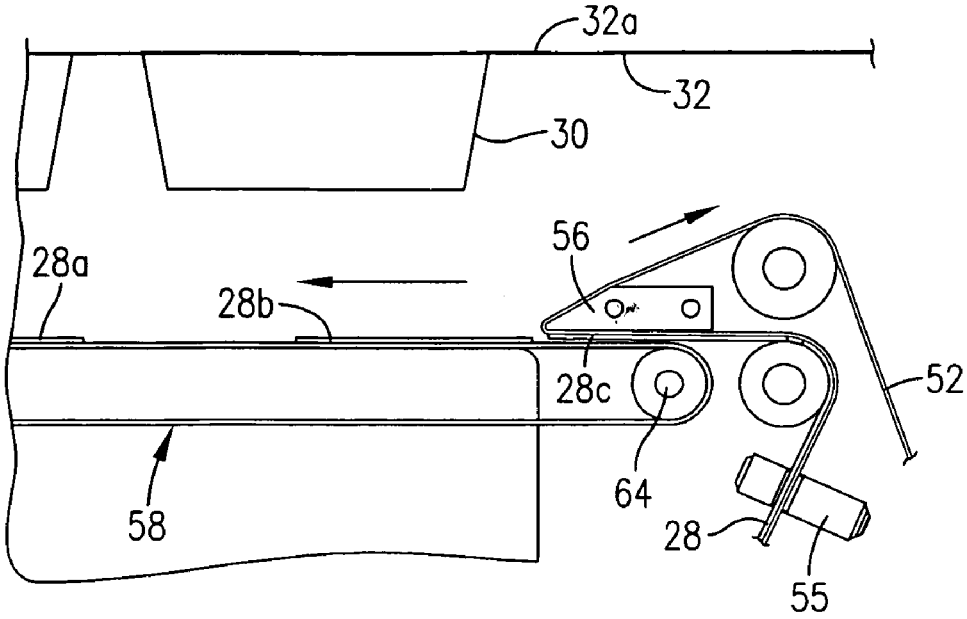
FIG. 14 is a schematic side view depicting the orientation of an initial label of a plurality of labels in accordance with the invention, after the initial label is fully separated from the peelbar.
Figure 15:
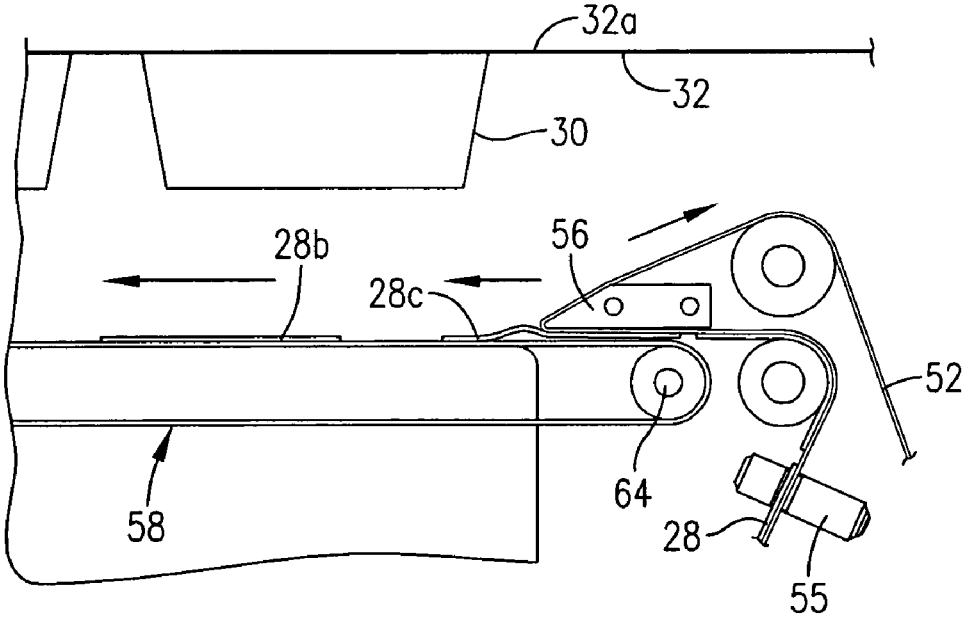
FIG. 15 is a view similar to that of FIG. 14, but showing dispensing of the next label of the plurality thereof, wherein the transport belt speed is greater than the speed of the next label as it is peeled by the peelbar, resulting in slippage between the transport belt and the next label.

The device 20 may be used with a conventional form, fill and seal packaging machine. Such machines typically include laterally spaced apart, fore and aft extending side rails supporting powered roller chains. The roller chains are designed to grip and incrementally advance a synthetic resin web 32 (FIGS. 14 and 15). The web 32 is first advanced to a forming station wherein the packages 30 are heat-formed, and thence through a filling station where product is placed within the packages 30. At this point, the filled packages are advanced to a sealing station where a top web 32*a* is affixed to the filled packages 30. Thereafter, the sealed packages are separated and placed into cartons or the like for shipping. During the course of operation of such forms, fill and seal equipment, it is common to attach labels to the undersides of the packages 30 and/or to the top web 32*a*. In the illustrated FIG. 1 embodiment, the device 20 is designed to apply labels to the undersides of the packages 30.

The frame assembly 26 includes elongated, fore and aft extending side rail bars 34 and 36, together with transverse cross bars 38 and 40. Additionally, a pair of vertically spaced apart, transversely extending stabilization bars 42 and 44 are provided, the latter being operably connected to rail bars 34 and 36 by means of shiftable couplers 46 and 48. The overall frame assembly 26 is operatively secured to a form, fill and seal machine by conventional means.

Figure 5:
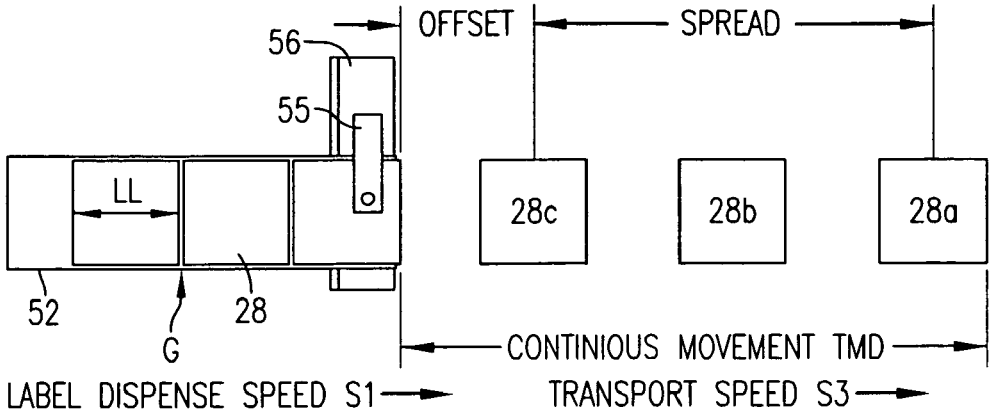
FIG. 5 is a schematic plan representation of the orientation of a plurality of labels dispensed in accordance with the present invention and ready for application to packages.
Figure 6:
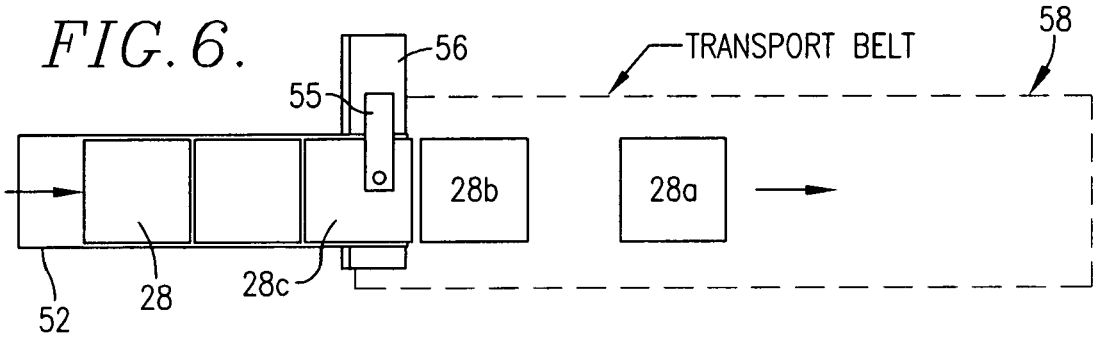
FIG. 6 is a schematic plan representation illustrating the location of the first two of a plurality of labels dispensed in accordance with the present invention.
Figure 7:
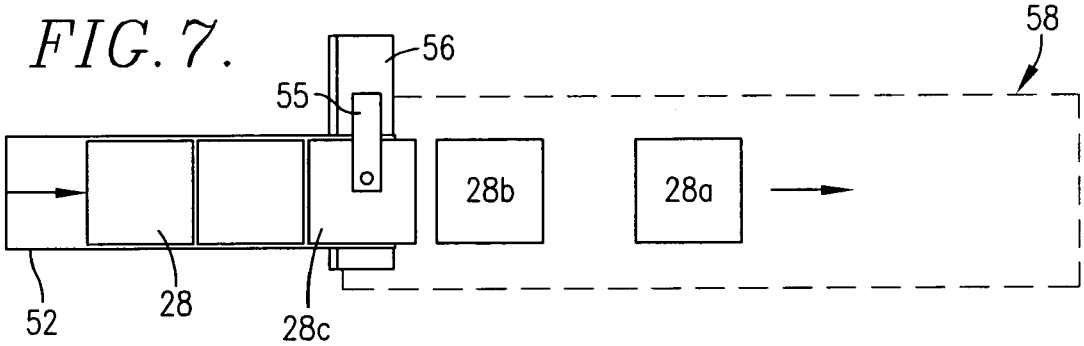
FIG. 7 is a view similar to that of FIG. 6, showing the next stage of the label dispensing operation.
Figure 8:
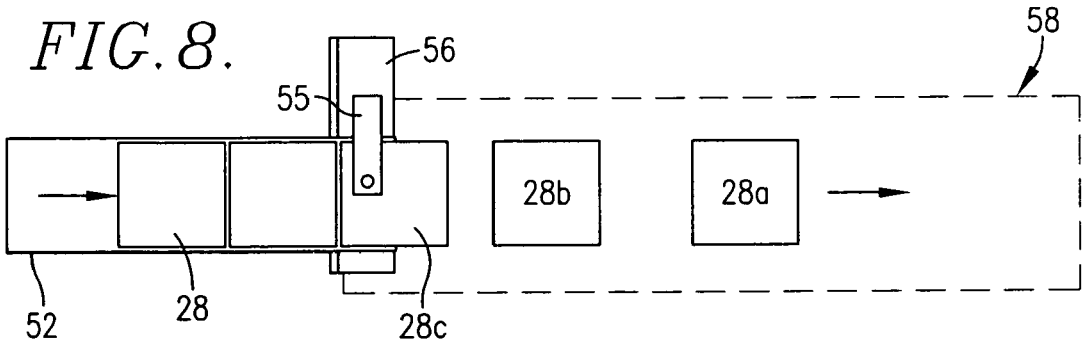
FIG. 8 is a view similar to that of FIG. 7, showing the next stage of the label dispensing operation.
Figure 9:
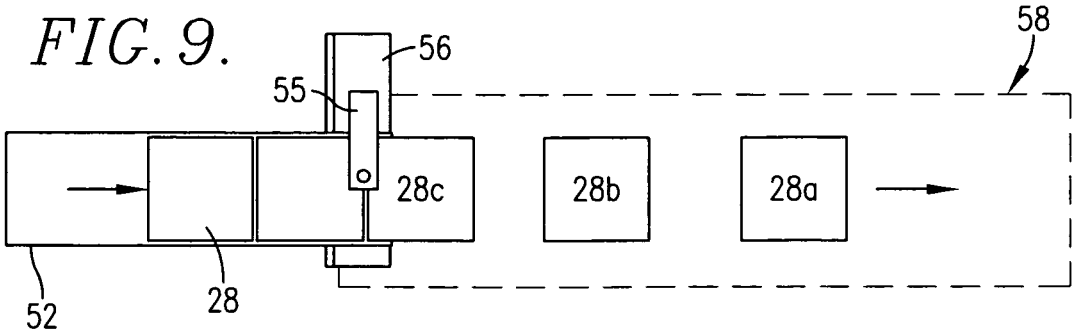
FIG. 9 is a view similar to that of FIG. 8, showing the next stage of the label dispensing operation.
Figure 10:
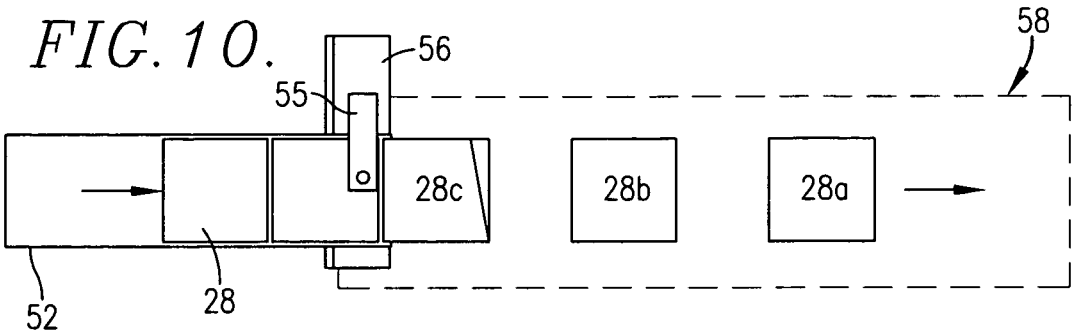
FIG. 10 is a view similar to that of FIG. 9, showing the next stage of the label dispensing operation.
Figure 11:
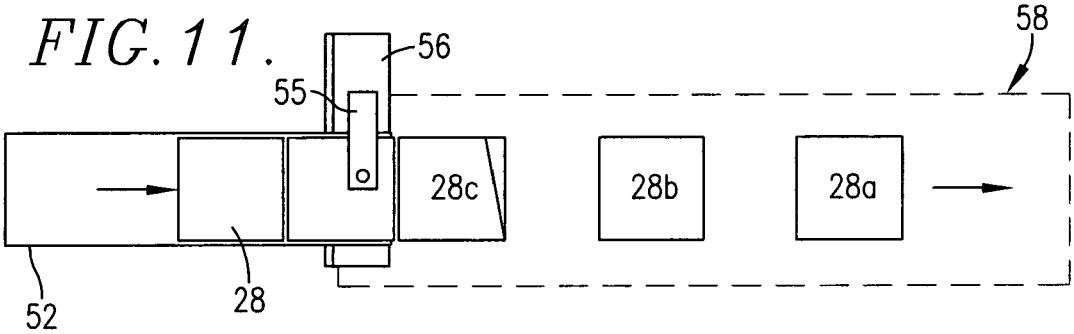
FIG. 11 is a view similar to that of FIG. 10, showing the next stage of the label dispensing operation.
Figure 12:
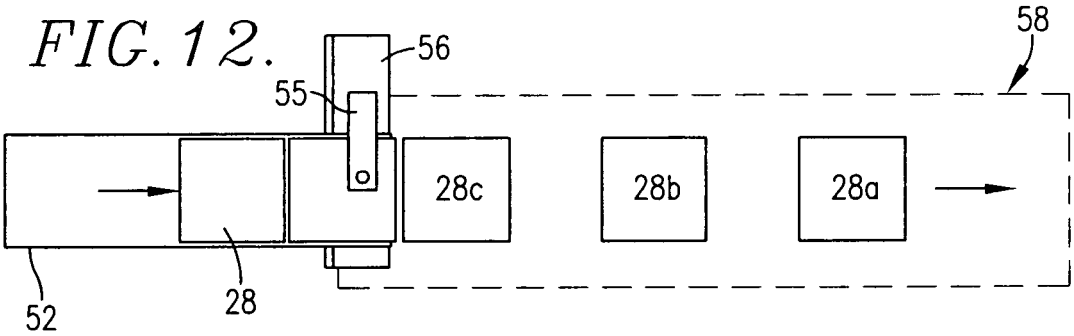
FIG. 12 is a view similar to that of FIG. 11, showing the next stage of the label dispensing operation.
Figure 13:
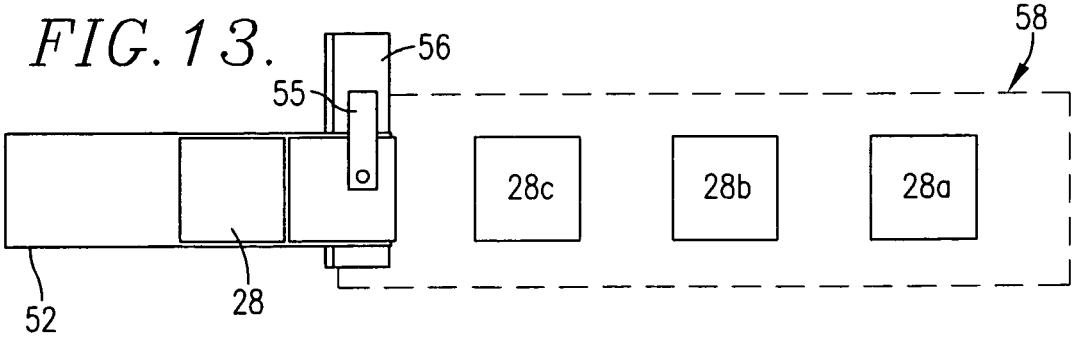
FIG. 13 is a view similar to that of FIG. 12, showing the next stage of the label dispensing operation.

The label dispensing unit 22 includes a label supply reel 50 for holding and dispensing an elongated label-supporting web 52 bearing spaced labels 28 thereon, with respective adjacent labels being spaced apart by a short gap distance G (FIG. 5). Additionally, the dispensing unit 22 has a take up roller 53 to recover the web 52. A multiple-roller dancer or tensioning assembly 54 provided between reel 50 and the take up roller for supporting web 52 during advancement thereof while also controlling the tension of the web 52 during label delivery. The assembly 54 is powered and controlled by means of stepper motor 54*a*. A label sensor 55 and wedge-shaped peelbar 56 are located adjacent the label delivery location in order to sense the position of the labels 28 and to detach the labels from web 52 as will be described.

The transport assembly 24 includes a label belt 58 designed to received detached, adhesive side up labels 28 from the unit 22, and to move the labels into a position for engagement and shifting thereof for labeling of the packages 30. The overall device 20 also has a tamping assembly 60 associated with belt 58 and operable to engage and rapid move the labels 28 from the belt 58 and into labeling engagement with the packages 30. In particular, the belt 58 includes a pair of endmost belt shafts 62 and 64 supporting a plurality of continuous, spaced apart belts 66. The belts 66 are movable to the medium of stepper motor 68 coupled with shaft 62 in timed and speed-controlled relationship with the remainder of device 20.

The tamping assembly 60 has a plurality of upright, laterally extending, spaced apart, hollow plates 70 which each have an uppermost open labeling end and an opposed, lower open end. The plates 70 are in side-by-side adjacency and are shiftable in unison as a pack or assembly, i.e., the plates 70 are secured adjacent the lower ends thereof to a cross piece 72. The complete assembly 60 also includes apparatus 74 drawing air through the plates 70 in order to create reduced pressure conditions adjacent the upper open ends. The apparatus 74 has an apertured fan mount 76 supporting a pair of electrically operated fans 78. Operation of the fan 78 serves to draw air through the plates 70.

The device 20 is equipped with one or more conventional control devices which are operably coupled with the sensor 55 as well as stepper motors 54*a* and 68 respectively control the operation of the sensing unit 22 and transport assembly 24 in a manner described below. A variety of control devices can be used, e.g., an industrial C-programmable controller. The control devices may be programmed with one or more computer programs to control operation of the present invention as described herein. The computer program preferably comprises an ordered listing of executable instructions for implementing logical functions in the control devices. The computer program can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electromagnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). The computer-readable medium could even be paper or another suitable medium upon which the program is printed, as the program can be electronically captured, via for instance, optical scanning of the paper or other medium, then compiled, interpreted, or otherwise processed in a suitable manner, if necessary, and then stored in a computer memory.

Generally, the device 20, when mounted on a form, fill and seal machine, dispenses a plurality of labels across the individually formed packages in a location where the labels can be properly applied to each respective package. Once the labels are properly positioned across belt 58, the tamper assembly 60 comes into play to move the adhesive-bearing faces of the labels into contact with the packages 30. The packaging machine then shifts the web 30 forwardly until a new array of packages 30 is presented at the device 20 for packaging.

The device 20 is described in complete detail in U.S. Pat. No. 6,868,887 incorporated by reference herein. Specifically, all of the hardware aspects of device 20 are identical with that of the labeler described in the '887 patent. The difference between the present invention and the disclosure of the '887 patent resides in the label dispensing operation of the unit 22 and assembly 24, described below.

Labeler Apparatus Control

As indicated above, the present invention is concerned with novel labeler control methods and apparatus which permit very significant increases in labeler operation. In order to better understand the present invention, and the differences between the invention and the prior art, the conventional control systems are first discussed, followed by a description of the control systems of the invention. These exemplary discussions are based upon a situation where three labels 28*a*, 28*b* and 28*c* are dispensed per labeling cycle, using the preferred labeling device 20 described above.

1. The Prior Art

Currently, labelers of the type described above and in U.S. Pat. No. 6,868,887 are controlled such that plural labels are individually dispensed and transported in distinct movements. This results in a time-consuming stop-start movement of the labeler dispensing unit and transport assemblies.

Figure 2:
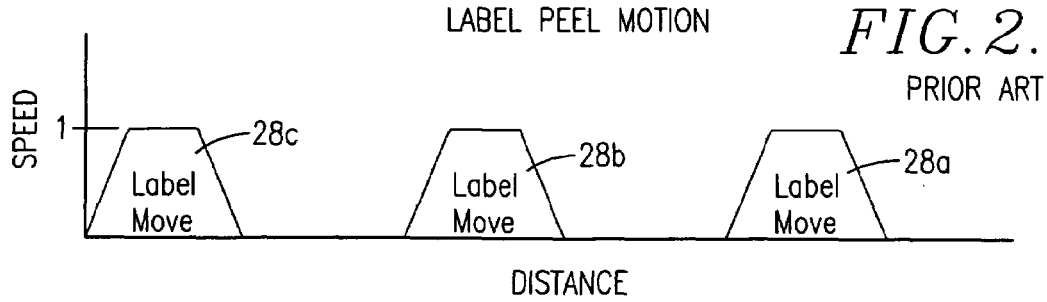
FIG. 2. PRIOR ART
FIG. 2 is a speed vs. distance graph illustrating the dispensing operation of a convention prior art label dispensing unit, a component of the overall labeler.
Figure 3:
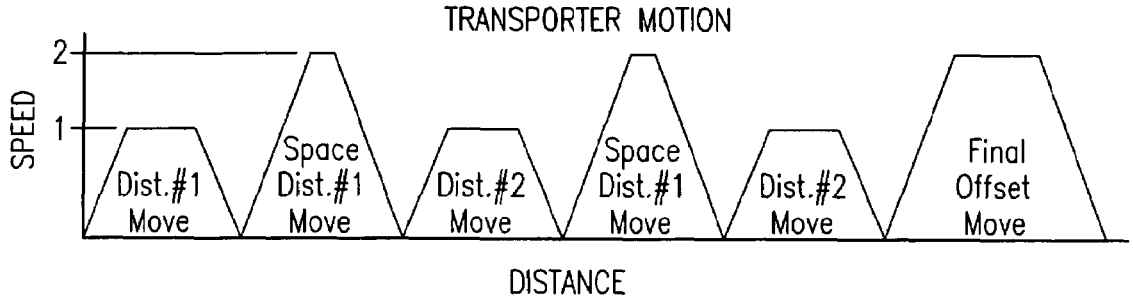
FIG. 3. PRIOR ART
FIG. 3 is a speed vs. distance graph corresponding to that of FIG. 2 and illustrating the operation of a convention prior art label transport assembly, another component of the labeler.

Attention is directed to FIGS. 2 and 3 which are respectively speed vs. distance graphs showing the operation of the label dispensing unit 22 (FIG. 2) and the label transporting assembly 24 (FIG. 3).

Referring first to FIG. 2, it will be seen that the label dispensing unit is operated in three distinct, time-separated instances at speed 1. On the other hand, the belt 58 of transport assembly 24 is moved a total of 6 times at varying speeds. Specifically, during the three movements of the dispensing unit shown in FIG. 2, the belt 58 is correspondingly moved at the exact same speed 1 as the dispensing unit 24. However, between these movements the belt 58 is moved twice at a speed 2 over distance 1 in order to effect proper spacing between the three labels. The final offset move also occurs at speed 2, to give the desired offset distance. In this control system, it is important that both the dispensing unit 24 and the belt 58 move at exactly the same linear speeds; however, the intermediate spacing movements of the belt 58, and the final offset move, may be at any selected speed, and need not be at the same speeds.

This distance-based prior art approach results in very accurate label placement, but requires considerable time to execute, owing to the number of separate moves required, each with an acceleration and deceleration time.

2. The Present Invention

Figure 4:
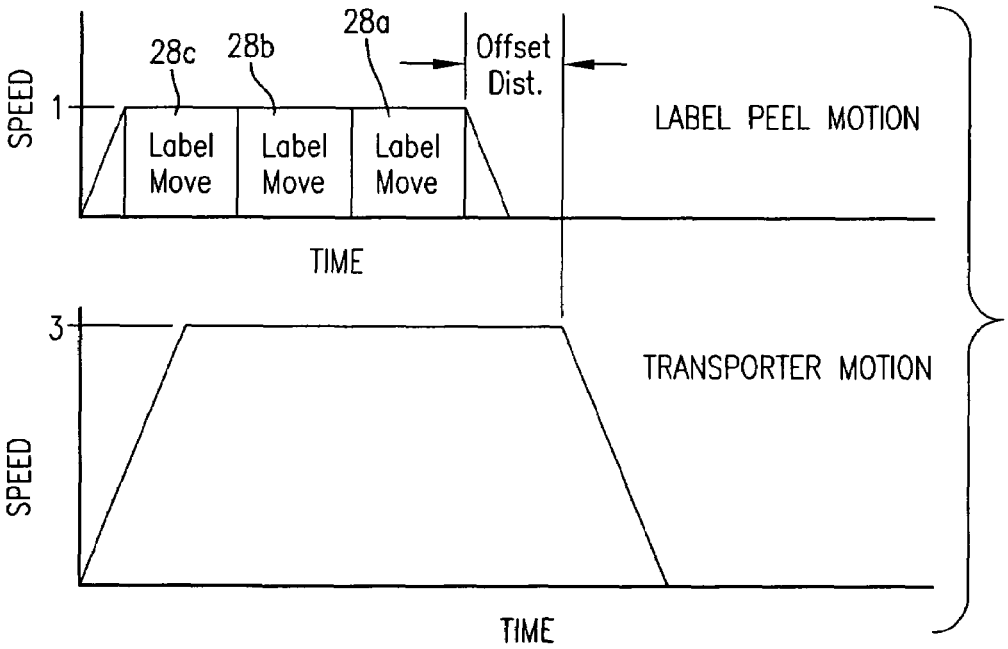
FIG. 4 is a speed vs. distance graph illustrating the simultaneous operation of a label dispensing unit and label transport assembly in the present invention.

The present invention makes use of a velocity ratio approach wherein the labels are moved as a group in a "burst" fashion without any intermediate stopping of the dispensing unit between individual labels. Referring to FIG. 4, the sequential movement of the label dispensing unit 22 and belt 58 of transport assembly 24 are shown. It will be appreciated from a consideration of these graphs that all of the labels are moved in a single sequence at a constant speed 1. At the same time, the belt 58 is moved at a different speed 3 so as to achieve the label spacing illustrated in FIG. 5 where the labels 28*a*, 28*b* and 28*c* are each separated an appropriate distance and the label group is offset from the label dispensing location.

During simultaneous movement of the dispensing unit 22 and belt 58 of transport assembly 24, the spacing between the labels 28*a*, 28*b* and 28*c* is created on the fly by virtue of the different speeds 1 and 3 and the ratio between these speeds. Generally, the belt 58 is moved at a higher speed 3 as compared with the speed 1 of the labels as they are peeled by the peelbar, and the labels do not attain the same speed 3 until they are released at the last instant from the web 52 at the forward edge of peelbar 56. Consequently, a slippage occurs between the faster moving belt 58 and the slower moving labels 28*a*, 28*b* and 28*c*, until the labels are completely separated from the web 52. This phenomenon is illustrated in FIGS. 14 and 15. In FIG. 14, the labels 28*a* and 28*b* are fully separated from web 52 and travel at the same speed as belt 58. As label 28*c* is peeled from the web 52 by peelbar 56, the label 28*c* travels at a speed less than that of belt 58, until the peel-off is completed. This is not a problem with the device 20, because the labels are peeled with their adhesive-bearing faces upwardly, and the pneumatic hold-down provided by the tamping assembly 60 allows such relative slippage.

FIGS. 6-13 illustrate the sequential steps followed in dispensing of the labels 28*a*, 28*b* and 28*c* across belt 58 as the latter is moved in timed relationship with the label removal effected by the unit 22. As shown, as each label is stripped from web 52 because of movement of the web 52 around peelbar 56, the labels instantaneously begin moving at the speed of the belt 58 so that proper spacing of the labels across the belt (FIG. 13) is achieved. As explained previously, during the peel-off operation, there is a slippage between the respective labels and belt 58.

The foregoing description refers to dispensing of three labels per labeling cycle. However, the invention is not limited to any particular number of labels per cycle. Therefore, the generalized case where N labels are dispensed per cycle can be described as follows, where:

LL=label length

G=gap between labels on supporting web

N=number of labels dispensed per cycle

Spread=total center-to-center spread between the initial and final labels

Offset=distance between center line of final label and dispensing location

S1=label dispensing unit speed

S3=transport assembly speed

TMD=transport move distance

Label registration is accomplished by sensing of the first label gap G by the sensor 55 and a distance $(N-1)\times LL$ is added as the label Offset. At the same time, a distance move is made by the belt 58 which is equal to $TMD=LL/2+Spread+Offset$. This distance move TMD is made at a $S3=S1\times(Spread/(N\times(LL+G)))$. The Offset parameter is used to adjust the position of the group of labels, and thus is not entered into the calculation of S3.

I claim:

1. A method of substantially simultaneously labeling a plurality of spaced apart articles by dispensing a plurality of labels from a continuous web supporting a number of said labels in spaced relationship, said method comprising the steps of:

separating said plurality of labels as a group from said web, and depositing said separated labels onto a transport component, said label-separating step comprising the step of continuously moving said web without intermediate stopping of the web until said plurality of labels has been removed as a group from the web;

continuously moving said component during said label-removal and depositing steps so that the plurality of labels is deposited as a group on the component without interrupting the continuous movement of the component, locating said plurality of labels in spaced apart relationship on said component and adjacent said plurality of articles at least in part because of a difference in speed between said web and transport component; and substantially simultaneously applying said plurality of labels to said plurality of spaced apart articles.

2. The method of claim 1, said label-separating step comprising the steps of passing said web adjacent a peelbar, and causing the peelbar to remove the labels.

3. The method of claim 1, including the step of moving said component at a speed greater than the speed of said web during said label-separating step.

4. The method of claim 1, said component comprising a shiftable belt.

5. In a method of operating a labeling device in order to substantially simultaneously label a plurality of spaced apart packages, the labeler including a label dispensing unit comprising a continuous label-bearing web operable to sequentially deliver a plurality of labels to a delivery location, and a label transport assembly presenting a shiftable, label-receiving continuous belt operable to receive labels from said unit as they are sequentially delivered at said location, the improvement which comprises the step of continuously moving said web during said delivery of said plurality of labels therefrom so that the plurality of labels is delivered onto the belt as a group without interrupting the continuous movement of the web during said delivery of said group of labels.

6. The method of claim 5, said labels supported on an elongated web, said method including the step of causing relative slippage between said labels and said belt until the respective labels are fully separated from said web.

7. The method of claim 5, including the step of continuously moving said component during said removal of said plurality of said labels as a group from said web.

8. The method of claim 7, including the step of moving said belt at a speed greater than the speed of said web.

9. In a method of operating a labeling device in order to substantially simultaneously label a plurality of spaced apart packages, the labeler including a label dispensing unit comprising a continuous label-bearing web operable to sequentially deliver a plurality of labels to a delivery location, and a label transport assembly presenting a shiftable label-receiving component operable to receive labels from said unit as they are sequentially delivered at said location, the improvement which comprises the step of continuously moving said web during said delivery of said plurality of labels therefrom so that the plurality of labels is delivered onto the component as a group without interrupting the continuous movement of the web during said delivery of said group of labels, and causing relative slippage between said labels and said component until the respective labels are fully separated from said web.

10. In a method of operating a labeling device in order to substantially simultaneously label a plurality of spaced apart packages, the labeler including a label dispensing unit comprising a continuous label-bearing web operable to sequentially deliver a plurality of labels to a delivery location, and a label transport assembly presenting a shiftable label-receiving component operable to receive labels from said unit as they are sequentially delivered at said location, the improvement which comprises the step of continuously moving said web during said delivery of said plurality of labels therefrom so that the plurality of labels is delivered onto the component as a group without interrupting the continuous movement of the web during said delivery of said group of labels, and continuously moving said component during said delivery of said labels of a group from said web.

* * * * *